US010916184B2

(12) United States Patent
Xuan et al.

(10) Patent No.: US 10,916,184 B2
(45) Date of Patent: Feb. 9, 2021

(54) ARRAY SUBSTRATE AND DRIVING METHOD THEREOF, DISPLAY PANEL, DISPLAY DEVICE

(71) Applicant: BOE TECHNOLOGY GROUP CO., LTD., Beijing (CN)

(72) Inventors: Minghua Xuan, Beijing (CN); Lei Wang, Beijing (CN); Li Xiao, Beijing (CN); Shengji Yang, Beijing (CN); Pengcheng Lu, Beijing (CN); Xiaochuan Chen, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 18 days.

(21) Appl. No.: 16/339,513

(22) PCT Filed: Jul. 4, 2018

(86) PCT No.: PCT/CN2018/094417
§ 371 (c)(1),
(2) Date: Apr. 4, 2019

(87) PCT Pub. No.: WO2019/062255
PCT Pub. Date: Apr. 4, 2019

(65) Prior Publication Data

US 2020/0051491 A1 Feb. 13, 2020

(30) Foreign Application Priority Data

Sep. 28, 2017 (CN) ..... 2017 1 0897464

(51) Int. Cl.
*G09G 3/32* (2016.01)

(52) U.S. Cl.
CPC ..... *G09G 3/32* (2013.01); *G09G 2300/0408* (2013.01)

(58) Field of Classification Search
CPC ..... G09G 3/32; G09G 2300/0408; G09G 2300/0861; G09G 2300/0819; G09G 3/3275; G09G 2310/0297; G09G 3/3233
See application file for complete search history.

(56) References Cited

U.S. PATENT DOCUMENTS

2016/0203776 A1* 7/2016 Choo ..... G09G 3/3607 345/694

FOREIGN PATENT DOCUMENTS

CN 101930077 A 12/2010
CN 103163697 A 6/2013
(Continued)

OTHER PUBLICATIONS

First Office Action for CN Appl. No. 201710897464.0, dated Mar. 20, 2019.

(Continued)

*Primary Examiner* — Rodney Amadiz
(74) *Attorney, Agent, or Firm* — The Webb Law Firm

(57) ABSTRACT

Embodiments of the present disclosure provide an array substrate and a driving method thereof, a display panel as well as a display device. The array substrate comprises: m rows and n columns of subpixels, wherein m and n are positive integers; a plurality of gate lines, wherein if m is an even number, when i<(m+1)/2, the ith gate line is connected to the subpixels in the (2i−1)th row and the 2ith row, and wherein if m is an odd number, when i<(m+1)/2, the ith gate line is connected to the subpixels in the (2i−1)th row and the 2ith row and when i=(m+1)/2, the ith gate line is connected to the subpixels in the mth row, wherein i is a positive integer less than or equal to (m+1)/2; and a plurality of data lines, wherein each column of subpixels corresponds to two data lines coupled to the subpixels.

19 Claims, 6 Drawing Sheets

(56) References Cited

FOREIGN PATENT DOCUMENTS

| | | | |
|---|---|---|---|
| CN | 103197481 | A | 7/2013 |
| CN | 103529610 | A | 1/2014 |
| CN | 104485071 | A | 4/2015 |
| CN | 105185305 | A | 12/2015 |
| CN | 105679236 | A | 6/2016 |
| CN | 105761675 | A | 7/2016 |
| CN | 105788544 | A | 7/2016 |
| CN | 105206220 | A | 11/2016 |
| CN | 106097964 | A | 11/2016 |
| CN | 106128360 | A | 11/2016 |
| CN | 107610640 | A | 1/2018 |
| KR | 20120073793 | A | 7/2012 |

OTHER PUBLICATIONS

International Search Report and Written Opinion for International Appl. No. PCT/CN2018/094417, dated Sep. 25, 2018.

* cited by examiner

ARRAY SUBSTRATE AND DRIVING METHOD THEREOF, DISPLAY PANEL, DISPLAY DEVICE

CROSS-REFERENCE TO RELATED APPLICATIONS

The present application claims priority under 35 U.S.C. § 371 to International Patent Application No. PCT/CN2018/094417 filed on Jul. 4, 2018, which claims priority to Chinese Patent Application No. 201710897464.0 filed on Sep. 28, 2017. The entire contents of both applications are incorporated into the present disclosure by means of reference for all purposes.

TECHNICAL FIELD

The present disclosure relates to an array substrate and a driving method, a display panel, and a display device.

BACKGROUND

An electroluminescent diode as a current-type light-emitting device is advantageous for its low energy consumption, low production cost, self-luminous property, wide viewing angle and rapid response, and thus it is widely used in the high-performance display field.

It is desirable to provide an improved display panel comprising electroluminescent diodes.

SUMMARY

The present disclosure provides an array substrate and a driving method, a display panel as well as a display device.

A first aspect of the present disclosure provides an array substrate, comprising: m rows and n columns of subpixels, wherein m and n are positive integers; a plurality of gate lines, wherein when $i<(m+1)/2$, the ith gate line is connected to the subpixels in the $(2i-1)$th row and the 2ith row, and if m is an odd number, when $i=(m+1)/2$, the ith gate line is connected to the subpixels in the mth row, wherein i is a positive integer less than or equal to $(m+1)/2$; a plurality of data lines, wherein each column of subpixels corresponds to two data lines that include a first data line and a second data line, wherein the first data line is connected to the subpixels in the column which are in odd rows, and the second data line is connected to the subpixels in the column which are in even rows.

In at least one embodiment, the array substrate further comprises a first data selector and a second data selector, the first data selector and the second data selector including n data selection circuits, wherein: data selection circuits of the first data selector, responsive to a first data selection signal, provide to the first data line of each column of subpixels data signals of the subpixels in the column; data selection circuits of the second data selector, responsive to a second data selection signal, provide to the second data line of the column of subpixels data signals of the subpixels in the column, wherein the first data selection signal and the second data selection signal have opposite phases.

In at least one embodiment, each data selection circuit comprises a control terminal, a first terminal and a second terminal, wherein:

in the data selection circuit of the first data selector, the control terminal receives a selection signal of the first data selector, the first terminal is connected to the first data line of each column of subpixels, and the second terminal receives the data signal; in the data selection circuit of the second data selector, the control terminal receives a selection signal of the second data selector, the first terminal is connected to the second data line of each column of subpixels, and the second terminal receives the data signal.

In at least one embodiment, the subpixel comprises a pixel circuit, the pixel circuit comprises an electroluminescent diode, a storage capacitor, a driving sub-circuit and six switching sub-circuits; wherein each switching sub-circuit comprises a control terminal, a first signal terminal and a second signal terminal, wherein a control signal inputted at the control terminal of the switching sub-circuit can turn on or off the first signal terminal and the second signal terminal; the driving sub-circuit comprises a control terminal, a signal input terminal and an output terminal, wherein the control terminal and the signal input terminal of the driving sub-circuit are used to control output of a drive signal at the drive terminal; the storage capacitor comprises a first terminal and a second terminal, wherein a first power source signal is inputted to the first terminal, the second terminal is connected to the control terminal of the driving sub-circuit, and the storage capacitor is used to maintain potential at the control terminal of the driving sub-circuit; the electroluminescent diode comprises a first terminal and a second terminal, wherein the first terminal is connected to the output terminal of the driving sub-circuit, a second power source signal is inputted to the second terminal, and the electroluminescent diode is used for emitting light in response to a light-emission control signal; the control terminal of the driving sub-circuit is connected to the second terminal of the storage capacitor, a first power source signal or the data signal on the data line is inputted to the signal input terminal, the output terminal is connected to the first terminal of the electroluminescent diode, and the driving sub-circuit is used for to drive the electroluminescent diode to emit light;

in the first switching sub-circuit, a reset control signal is inputted to the control terminal, a reset power source signal is inputted to the first signal terminal, the second signal terminal is connected to the control terminal of the driving sub-circuit, and the switching sub-circuit is configured to be turned on in response to the reset control signal in order to transmit the reset power source signal to the control terminal of the driving sub-circuit;

in the second switching sub-circuit, a write control signal is inputted to the control terminal, the first signal terminal is connected to the control terminal of the driving sub-circuit, the second signal terminal is connected to the output terminal of the driving sub-circuit, and the switching sub-circuit is configured to be turned on in response to the write control signal on the gate line in order to connect the control terminal of the driving sub-circuit with the output terminal of the driving sub-circuit;

in the fourth switching sub-circuit, a light-emission control signal is inputted to the control terminal, a first power source signal is inputted to the first signal terminal, the second signal terminal is connected to the signal input terminal of the driving sub-circuit, and the switching sub-circuit is configured to be turned on in response to the light-emission control signal in order to transmit the first power source signal to the signal input terminal of the driving sub-circuit;

in the fifth switching sub-circuit, a light-emission control signal is inputted to the control terminal, the first signal terminal is connected to the output terminal of the driving sub-circuit, the second signal terminal is connected to the first terminal of the electroluminescent diode, and the switching sub-circuit is configured to be turned on in response to the light-emission control signal in order to transmit the signal at the output terminal of the driving sub-circuit to the first terminal of the electroluminescent diode;

in the sixth switching sub-circuit, a write control signal is inputted to the control terminal, the data signal on the data line is inputted to the first signal terminal, the second signal terminal is connected to the signal input terminal of the driving sub-circuit, and the switching sub-circuit is configured to be turned on in response to the write control signal in order to transmit the data signal on the data line to the signal input terminal of the driving sub-circuit;

in the seventh switching sub-circuit, a write control signal is inputted to the control terminal, the reset power source signal is inputted to the first signal terminal, the second signal terminal is connected to the first terminal of the electroluminescent diode, and the switching sub-circuit is configured to be turned on in response to the write control signal on the gate line in order to transmit the reset power source signal to the first terminal of the electroluminescent diode.

In at least one embodiment, the first switching sub-circuit, the second switching sub-circuit, and the fourth to eighth switching sub-circuits are switching transistors, wherein a gate electrode of the switching transistor serves as the control terminal of the switching sub-circuit, a source electrode of the switching transistor serves as the first signal terminal or the second signal terminal of the switching sub-circuit, and a drain electrode of the switching transistor serves as the second signal terminal or the first signal terminal of the switching sub-circuit; the driving sub-circuit is a driving transistor, wherein a gate electrode of the driving transistor serves as the control terminal of the driving sub-circuit, a source electrode of the driving transistor serves as the signal input terminal of the driving sub-circuit, and a drain electrode of the driving transistor serves as the output terminal of the driving sub-circuit.

In at least one embodiment, the subpixel comprises a pixel circuit, the pixel circuit comprises an electroluminescent diode, a storage capacitor, a driving sub-circuit and seven switching sub-circuits; wherein each switching sub-circuit comprises a control terminal, a first signal terminal and a second signal terminal, wherein a control signal inputted at the control terminal of the switching sub-circuit can turn on or off the first signal terminal and the second signal terminal; the driving sub-circuit comprises a control terminal, a signal input terminal and an output terminal, wherein the control terminal and the signal input terminal of the driving sub-circuit are used to control output of a drive signal at the drive terminal; the storage capacitor comprises a first terminal and a second terminal, wherein a reference power source signal or the data signal on the data line is inputted to the first terminal, the second terminal is connected to the control terminal of the driving sub-circuit, and the storage capacitor is used to maintain potential at the control terminal of the driving sub-circuit; the electroluminescent diode comprises a first terminal and a second terminal, wherein the first terminal is connected to the output terminal of the driving sub-circuit, a second power source signal is inputted to the second terminal, and the electroluminescent diode is used for emitting light in response to a light-emission control signal; the control terminal of the driving sub-circuit is connected to the second terminal of the storage capacitor, a first power source signal is inputted to the signal input terminal, the output terminal is connected to the first terminal of the electroluminescent diode, and the driving sub-circuit is used for to drive the electroluminescent diode to emit light;

in the first switching sub-circuit, a reset control signal is inputted to the control terminal, a reset power source signal is inputted to the first signal terminal, the second signal terminal is connected to the control terminal of the driving sub-circuit, and the switching sub-circuit is configured to be turned on in response to the reset control signal in order to transmit the reset power source signal to the control terminal of the driving sub-circuit;

in the second switching sub-circuit, a write control signal is inputted to the control terminal, the first signal terminal is connected to the control terminal of the driving sub-circuit, the second signal terminal is connected to the output terminal of the driving sub-circuit, and the switching sub-circuit is configured to be turned on in response to the write control signal on the gate line in order to connect the control terminal of the driving sub-circuit with the output terminal of the driving sub-circuit;

in the fourth switching sub-circuit, a write control signal is inputted to the control terminal, the data signal on the data line is inputted to the first signal terminal, the second signal terminal is connected to the first terminal of the storage capacitor, and the switching sub-circuit is configured to be turned on in response to the write control signal on the gate line in order to transmit the data signal on the data line to the first terminal of the storage capacitor;

in the fifth switching sub-circuit, a reset control signal is inputted to the control terminal, a reference power source signal is inputted to the first signal terminal, the second signal terminal is connected to the first terminal of the storage capacitor, and the switching sub-circuit is configured to be turned on in response to the reset control signal in order to transmit the reference power source signal to the first terminal of the storage capacitor;

in the sixth switching sub-circuit, a light-emission control signal is inputted to the control terminal, a reference power source signal is inputted to the first signal terminal, the second signal terminal is connected to the first terminal of the storage capacitor, and the switching sub-circuit is configured to be turned on in response to the light-emission control signal in order to transmit the reference power source signal to the first terminal of the storage capacitor;

in the seventh switching sub-circuit, a light-emission control signal is inputted to the control terminal, the first signal terminal is connected to the output terminal of the driving sub-circuit, the second signal terminal is connected to the first terminal of the electroluminescent diode, and the switching sub-circuit is configured to be turned on in response to the light-emission control signal in order to transmit the signal at the output terminal of the driving sub-circuit to the first terminal of the electroluminescent diode;

in the eighth switching sub-circuit, a write control signal is inputted to the control terminal, a reset power source signal is inputted to the first signal terminal, the second signal terminal is connected to the first terminal of the electroluminescent diode, and the switching sub-circuit is configured to be turned on in response to the write control signal on the gate line in order to transmit the reset power source signal to the first terminal of the electroluminescent diode.

In at least one embodiment, the first switching sub-circuit, the second switching sub-circuit, and the fourth to eighth switching sub-circuits are switching transistors, wherein a gate electrode of the switching transistor serves as the control terminal of the switching sub-circuit, a source electrode of the switching transistor serves as the first signal terminal or the second signal terminal of the switching sub-circuit, and a drain electrode of the switching transistor serves as the second signal terminal or the first signal terminal of the switching sub-circuit;

the driving sub-circuit is a driving transistor, wherein a gate electrode of the driving transistor serves as the control terminal of the driving sub-circuit, a source electrode of the driving transistor serves as the signal input terminal of the driving sub-circuit, and a drain electrode of the driving transistor serves as the output terminal of the driving sub-circuit.

A second aspect of the present disclosure provides a method for driving an array substrate, comprising: when the ith gate line is scanned, transmitting, by the first data line of the subpixels of each column, the data signal to the subpixels corresponding to the (2i−1)th row, and transmitting, by the second data line of the subpixels of each column, the data signal to the subpixels corresponding to the 2ith row.

In at least one substrate, the array substrate further comprises a first data selector and a second data selector, the first data selector and the second data selector including n data selection circuits, the method further comprising: when the ith gate line is scanned, transmitting, by the first data line of the subpixels of each column, the data signal to the subpixels corresponding to the (2i−1)th row through the data selection circuit of the first data selector, and transmitting, by the second data line of the subpixels of each column, the data signal to the subpixels corresponding to the 2ith row through the data selection circuit of the second data selector.

In at least one embodiment, the subpixel comprises a pixel circuit, the pixel circuit comprises: an electroluminescent diode, a storage capacitor, a driving sub-circuit and six switching sub-circuits; wherein each switching sub-circuit comprises a control terminal, a first signal terminal and a second signal terminal, wherein a control signal inputted at the control terminal of the switching sub-circuit can turn on or off the first signal terminal and the second signal terminal; the driving sub-circuit comprises a control terminal, a signal input terminal and an output terminal, wherein the control terminal and the signal input terminal of the driving sub-circuit are used to control output of a drive signal at the drive terminal; the storage capacitor comprises a first terminal and a second terminal, wherein a first power source signal is inputted to the first terminal, the second terminal is connected to the control terminal of the driving sub-circuit, and the storage capacitor is used to maintain potential at the control terminal of the driving sub-circuit; the electroluminescent diode comprises a first terminal and a second terminal, wherein the first terminal is connected to the output terminal of the driving sub-circuit, a second power source signal is inputted to the second terminal, and the electroluminescent diode is used for emitting light in response to a light-emission control signal; the control terminal of the driving sub-circuit is connected to the second terminal of the storage capacitor, a first power source signal or the data signal on the data line is inputted to the signal input terminal, the output terminal is connected to the first terminal of the electroluminescent diode, and the driving sub-circuit is used for to drive the electroluminescent diode to emit light;

in the first switching sub-circuit, a reset control signal is inputted to the control terminal, a reset power source signal is inputted to the first signal terminal, the second signal terminal is connected to the control terminal of the driving sub-circuit, and the switching sub-circuit is configured to be turned on in response to the reset control signal in order to transmit the reset power source signal to the control terminal of the driving sub-circuit;

in the second switching sub-circuit, a write control signal is inputted to the control terminal, the first signal terminal is connected to the control terminal of the driving sub-circuit, the second signal terminal is connected to the output terminal of the driving sub-circuit, and the switching sub-circuit is configured to be turned on in response to the write control signal on the gate line in order to connect the control terminal of the driving sub-circuit with the output terminal of the driving sub-circuit;

in the fourth switching sub-circuit, a light-emission control signal is inputted to the control terminal, a first power source signal is inputted to the first signal terminal, the second signal terminal is connected to the signal input terminal of the driving sub-circuit, and the switching sub-circuit is configured to be turned on in response to the light-emission control signal in order to transmit the first power source signal to the signal input terminal of the driving sub-circuit;

in the fifth switching sub-circuit, a light-emission control signal is inputted to the control terminal, the first signal terminal is connected to the output terminal of the driving sub-circuit, the second signal terminal is connected to the first terminal of the electroluminescent diode, and the switching sub-circuit is configured to be turned on in response to the light-emission control signal in order to transmit the signal at the output terminal of the driving sub-circuit to the first terminal of the electroluminescent diode;

in the sixth switching sub-circuit, a write control signal is inputted to the control terminal, the data signal on the data line is inputted to the first signal terminal, the second signal terminal is connected to the signal input terminal of the driving sub-circuit, and the switching sub-circuit is configured to be turned on in response to the write control signal in order to transmit the data signal on the data line to the signal input terminal of the driving sub-circuit;

in the seventh switching sub-circuit, a write control signal is inputted to the control terminal, the reset power source signal is inputted to the first signal terminal, the second signal terminal is connected to the first terminal of the electroluminescent diode, and the switching sub-circuit is configured to be turned on in response to the write control signal on the gate line in order to transmit the reset power source signal to the first terminal of the electroluminescent diode;

the method comprising: a reset stage, in which the reset control signal is used to turn on the first switching sub-circuit and to turn off the second switching sub-circuit, the fourth switching sub-circuit, the fifth switching sub-circuit, the sixth switching sub-circuit and the seventh switching sub-circuit, such that the reset power source signal is transmitted to the control terminal of the driving sub-circuit, and the first power source and the reset power source are used to charge the storage capacitor;

a write stage, in which the write control signal on the gate line is used to turn on the second switching sub-circuit, the sixth switching sub-circuit and the seventh switching sub-circuit and to turn off the first switching sub-circuit, the fourth switching sub-circuit and the fifth switching sub-circuit, such that the first power source signal is written to the first terminal of the storage capacitor, the data signal and a threshold voltage of the driving sub-circuit are written to the second terminal of the storage capacitor, and the reset power source signal is transmitted to the subpixel; and a light-emission stage, in which the light-emission control signal is used to turn on the fourth switching sub-circuit and the fifth switching sub-circuit and to turn off the first switching sub-circuit, the second switching sub-circuit, the sixth switching sub-circuit and the seventh switching sub-circuit, such that the driving sub-circuit is turned on by the voltage signal in the storage capacitor to cause the first power source signal to drive the subpixel.

In at least one embodiment, the subpixel comprises a pixel circuit, the pixel circuit comprises: an electroluminescent diode, a storage capacitor, a driving sub-circuit and seven switching sub-circuits; wherein each switching sub-circuit comprises a control terminal, a first signal terminal and a second signal terminal, wherein a control signal inputted at the control terminal of the switching sub-circuit can turn on or off the first signal terminal and the second signal terminal; the driving sub-circuit comprises a control terminal, a signal input terminal and an output terminal, wherein the control terminal and the signal input terminal of the driving sub-circuit are used to control output of a drive signal at the drive terminal; the storage capacitor comprises a first terminal and a second terminal, wherein a reference power source signal or the data signal on the data line is inputted to the first terminal, the second terminal is connected to the control terminal of the driving sub-circuit, and the storage capacitor is used to maintain potential at the control terminal of the driving sub-circuit; the electroluminescent diode comprises a first terminal and a second terminal, wherein the first terminal is connected to the output terminal of the driving sub-circuit, a second power source signal is inputted to the second terminal, and the electroluminescent diode is used for emitting light in response to a light-emission control signal; the control terminal of the driving sub-circuit is connected to the second terminal of the storage capacitor, a first power source signal is inputted to the signal input terminal, the output terminal is connected to the first terminal of the electroluminescent diode, and the driving sub-circuit is used for to drive the electroluminescent diode to emit light;

in the first switching sub-circuit, a reset control signal is inputted to the control terminal, a reset power source signal is inputted to the first signal terminal, the second signal terminal is connected to the control terminal of the driving sub-circuit, and the switching sub-circuit is configured to be turned on in response to the reset control signal in order to transmit the reset power source signal to the control terminal of the driving sub-circuit;

in the second switching sub-circuit, a write control signal is inputted to the control terminal, the first signal terminal is connected to the control terminal of the driving sub-circuit, the second signal terminal is connected to the output terminal of the driving sub-circuit, and the switching sub-circuit is configured to be turned on in response to the write control signal on the gate line in order to connect the control terminal of the driving sub-circuit with the output terminal of the driving sub-circuit;

in the fourth switching sub-circuit, a write control signal is inputted to the control terminal, the data signal on the data line is inputted to the first signal terminal, the second signal terminal is connected to the first terminal of the storage capacitor, and the switching sub-circuit is configured to be turned on in response to the write control signal on the gate line in order to transmit the data signal on the data line to the first terminal of the storage capacitor;

in the fifth switching sub-circuit, a reset control signal is inputted to the control terminal, a reference power source signal is inputted to the first signal terminal, the second signal terminal is connected to the first terminal of the storage capacitor, and the switching sub-circuit is configured to be turned on in response to the reset control signal in order to transmit the reference power source signal to the first terminal of the storage capacitor;

in the sixth switching sub-circuit, a light-emission control signal is inputted to the control terminal, a reference power source signal is inputted to the first signal terminal, the second signal terminal is connected to the first terminal of the storage capacitor, and the switching sub-circuit is configured to be turned on in response to the light-emission control signal in order to transmit the reference power source signal to the first terminal of the storage capacitor;

in the seventh switching sub-circuit, a light-emission control signal is inputted to the control terminal, the first signal terminal is connected to the output terminal of the driving sub-circuit, the second signal terminal is connected to the first terminal of the electroluminescent diode, and the switching sub-circuit is configured to be turned on in response to the light-emission control signal in order to transmit the signal at the output terminal of the driving sub-circuit to the first terminal of the electroluminescent diode;

in the eighth switching sub-circuit, a write control signal is inputted to the control terminal, a reset power source signal is inputted to the first signal terminal, the second signal terminal is connected to the first terminal of the electroluminescent diode, and the switching sub-circuit is configured to be turned on in response to the write control signal on the gate line in order to transmit the reset power source signal to the first terminal of the electroluminescent diode;

the method comprising: a reset stage, in which the reset control signal is used to turn on the first switching sub-circuit and the fifth switching sub-circuit and to turn off the second switching sub-circuit, the fourth switching sub-circuit, the sixth switching sub-circuit, the seventh switching sub-circuit and the eighth switching sub-circuit, such that the reset power source signal is transmitted to the control terminal of the driving sub-circuit, and the first power source and the reset power source are used to charge the energy storage element;

a write stage, in which the write control signal is used to turn on the second switching sub-circuit, the fourth switching sub-circuit and the eighth switching sub-circuit and to turn off the first switching sub-circuit, the fifth switching sub-circuit, the sixth switching sub-circuit and the seventh switching sub-circuit, such that the data signal is written to the first terminal of the energy storage element, the data signal and a threshold voltage of the driving sub-circuit are written to the second terminal of the energy storage element, and the reset power source signal is transmitted to the subpixel; and a light-emission stage, in which the light-emission control signal is used to turn on the sixth switching sub-circuit and the seventh switching sub-circuit and to turn off the first switching sub-circuit, the second switching sub-circuit, the fourth switching sub-circuit, the fifth switching sub-circuit and the eighth switching sub-circuit, such that the reference power source signal is transmitted to the first terminal of the energy storage element, and the driving sub-circuit is turned on by the voltage signal in the energy storage element to cause the first power source signal to drive the subpixel.

A third aspect of the present disclosure provides a display panel, comprising the array substrate according to the first aspect.

A fourth aspect of the present disclosure provides a display device, comprising the display panel according to the third aspect.

BRIEF DESCRIPTION OF THE DRAWINGS

Embodiments of the present disclosure will be further described in details below with reference to the drawings.

DETAILED DESCRIPTION

Figure 1:
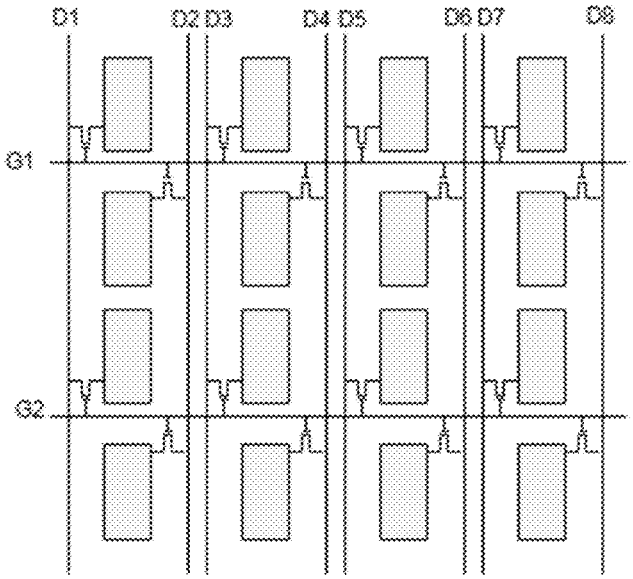
FIG. 1 is a schematic diagram showing an array substrate according to at least one embodiment of the present disclosure.

In order to illustrate the present disclosure in a clearer manner, the present disclosure is further illustrated below with reference to the examples and drawings. Similar components in the drawings are represented by the same reference sign. It shall be understood by those skilled in the art that the contents described below are illustrative instead of limiting, and the scope of protection sought for in the present disclosure shall not be limited thereby.

In a related electroluminescent diode display panel, due to a problem in the process for manufacturing the LTPS (Low Temperature Poly-silicon), the respective transistors have different threshold voltages, so that it is difficult to accurately control the control current of each pixel. Thus, it is needed to compensate for the threshold voltage of each pixel so as to obtain a more uniform and finer display panel. As the consumers have more and more severe requirements on display and higher and higher requirements on resolution, time to charge each pixel becomes shorter and shorter, such that it is difficult to compensate for the threshold voltage within a defined charging period, thereby resulting in a poor display effect.

Hence, it is desirable to provide an array substrate with an improved charging period and a driving method, a display panel as well as a display device.

An embodiment of the present disclosure provides m rows and n columns of subpixels; a plurality of gate lines, wherein when $i<(m+1)/2$, the ith gate line is connected to the subpixels in the $(2i-1)$th row and the 2ith row, and if m is an odd number, when $i=(m+1)/2$, the ith gate line is connected to the subpixels in the mth row; a plurality of data lines, wherein each column of subpixels corresponds to two data lines that include a first data line and a second data line, wherein the first data line is connected to the subpixels in the column which are in odd rows, and the second data line is connected to the subpixels in the column which are in even rows; wherein m and n are positive integers, and i is a positive integer less than or equal to $(m+1)/2$.

In an example, FIG. 1 illustrates an array substrate having 4 rows and 4 columns, comprising 2 gate lines and 8 data lines, i.e., one gate signal line is used to control two rows of subpixels, and two data signal lines are used to control one column of subpixels. A first gate signal line G1 is connected to adjacent two rows of subpixels including an odd row and an even row, i.e., the first and second rows of subpixels. Subpixels of the first column are connected to two data signal lines D1 and D2, wherein D1 is connected to the subpixels in odd rows in said column of subpixels, i.e., D1 is connected to subpixels in the first row and the third row, and D2 is connected to subpixels in even rows in said column of subpixels, i.e., D2 is connected to subpixels in the second row and the fourth row.

When G1 is turned on, D1 transmits the data signal to the subpixel in the first row, the first column, and likewise, D2 corresponds to the second row, the first column, D3 corresponds to the first row, the second column, D4 corresponds to the second row, the second column, D5 corresponds to the first row, the third column, D6 corresponds to the second row, the third column, D7 corresponds to the first row, the fourth column, and D8 corresponds to the second row, the fourth column. When G2 is turned on, D1 transmits the data signal to the subpixel in the third row, the first column, and likewise, D2 corresponds to the fourth row, the first column, D3 corresponds to the third row, the second column, D4 corresponds to the fourth row, the second column, D5 corresponds to the third row, the third column, D6 corresponds to the fourth row, the third column, D7 corresponds to the third row, the fourth column, and D8 corresponds to the fourth row, the fourth column.

When the array substrate comprises odd rows of subpixels, the last gate signal line controls the last row of subpixels, and data signal lines in odd columns transmit the data signal to the last row of subpixels.

According to said example, those skilled in the art may conceive that for an array substrate having m rows and n columns, when $i<(m+1)/2$, the ith gate line is connected to the subpixels in the $(2i-1)$th row and the 2ith row to drive said subpixels; if m is an odd number, when $i=(m+1)/2$, the ith gate line is connected to the subpixels in the mth row to drive said subpixels; each column of subpixels corresponds to two data lines that include a first data line and a second data line, wherein the first data line is connected to the subpixels in the column which are in odd rows, and the second data line is connected to the subpixels in the column which are in even rows; wherein m and n are positive integers, and i is a positive integer less than or equal to $(m+1)/2$.

At least one embodiment of the present disclosure provides a method for driving the array substrate. When the ith gate line is scanned, transmitting, by the first data line of the subpixels of each column, the data signal to the subpixels corresponding to the $(2i-1)$th row, and transmitting, by the second data line of the subpixels of each column, the data signal to the subpixels corresponding to the 2ith row.

In an example, FIG. 1 illustrates an array substrate having 4 rows and 4 columns, comprising 2 gate lines and 8 data lines. When G1 is turned on, D1, D3, D5 and D7 respectively transmit the data signal to the respective subpixels corresponding to the first row, and D2, D4, D6 and D8 respectively transmit the data signal to respective subpixels corresponding to the second row; when G2 is turned on, D1, D3, D5 and D7 respectively transmit the data signal to respective subpixels corresponding to the third row, and D2, D4, D6 and D8 respectively transmit the data signal to respective subpixels corresponding to the fourth row.

When the array substrate has an even number of rows that is represented by m, and the refresh frequency is, for example, 60 Hz, an effective time for each frame of image is 1/60=16.7 ms, and if one gate signal line corresponds to one row of subpixels, an effective time for each row of subpixels is (16.7/m) ms. In the present disclosure, one gate signal line is used to control two rows of subpixels, and thus, an effective time for each row of subpixels is ((16.7*2)/m) ms.

It follows that in case of equal scanning frequency, one gate signal line controls two rows of subpixels to perform double-line driving scanning, such that two rows of subpixels are charged at any time. In this case, charging time for each subpixel doubles, thereby ensuring the subpixels have sufficiently long charging time. This solution is particularly adapted to manufacturing of a display device with a large size and high resolution.

At least one embodiment of the present disclosure provides an array substrate having m rows and n columns, wherein the array substrate further comprises a first data selector and a second data selector, the first data selector and the second data selector including n data selection circuits, wherein: data selection circuits of the first data selector, responsive to a first data selection signal, provide to the first data line of each column of subpixels data signals of the subpixels in the column; data selection circuits of the second data selector, responsive to a second data selection signal, provide to the second data line of the column of subpixels data signals of the subpixels in the column, wherein the first data selection signal and the second data selection signal have opposite phases.

In at least one embodiment, each data selection circuit comprises a control terminal, a first terminal and a second terminal, wherein:

in the data selection circuit of the first data selector, the control terminal receives a first data selection signal, the first terminal is connected to the first data line of each column of subpixels, and the second terminal receives the data signal;

in the data selection circuit of the second data selector, the control terminal receives a selection signal of the second data selector, the first terminal is connected to the second data line of each column of subpixels, and the second terminal receives the data signal.

Figure 2:
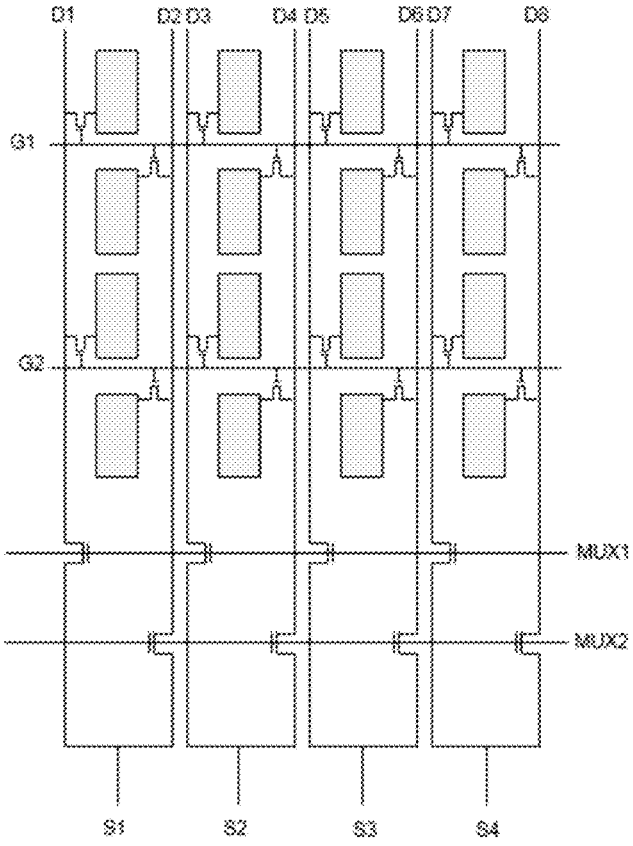
FIG. 2 is a schematic diagram showing an array substrate according to at least one embodiment of the present disclosure.

In an example, FIG. 2 illustrates an array substrate having 4 rows and 4 columns, comprising 2 gate lines and 8 data lines, wherein the array substrate further comprises a first data selector MUX1 and a second data selector MUX2. MUX1 and MUX2 each include 4 data selection circuits. In the data selection circuit of MUX1, the control terminal receives a first data selection signal, and in the figure, the first terminal of the first data selection circuit is connected to the data signal line D1, and a second terminal is connected to the data signal S1; likewise, in the second data selection circuit as shown in the figure, the first terminal is connected to D3, and the second terminal is connected to S2; in the third data selection circuit as shown in the figure, the first terminal is connected to D5, and the second terminal is connected to S3; and in the fourth data selection circuit as shown in the figure, the first terminal is connected to D7, and the second terminal is connected to S4. Likewise, in the data selection circuit of the second data selector MUX2, the control terminal receives a second data selection signal, the first terminal is connected to D2, D4, D6 and D8, respectively, and the second terminal is connected to S1, S2, S3 and S4, respectively.

The first data selection signal of MUX1 and the second data selection signal of MUX2 have opposite phases, i.e., a time period is divided into different time segments, for example, a time period is divided into two time segments, and during the first time segment of the period, MUX1 is valid and the data selection circuit of MUX1 is turned on, while during the second time segment of the period, MUX2 is valid and the data selection circuit of MUX2 is turned on.

When the gate signal line G1 is turned on, subpixels in the first row and the second row are valid, and during the first time segment of the period, MUX1 is turned on while MUX2 is turned off; S1 is connected to D1 through the data selection circuit and transmitted to the subpixel in the first row in the first column; S2 is connected to D3 through the data selection circuit and transmitted to the subpixel in the first row in the second column; S3 is connected to D5 through the data selection circuit and transmitted to the subpixel in the first row in the third column; S4 is connected to D7 through the data selection circuit and transmitted to the subpixel in the first row in the fourth column; during the second time segment of the period, MUX2 is valid while MUX1 is turned off; S1 is connected to D2 through the data selection circuit of the second data selector and transmitted to the subpixel in the second row in the first column; S2 is connected to D4 through the data selection circuit and transmitted to the subpixel in the second row in the second column; S3 is connected to D6 through the data selection circuit and transmitted to the subpixel in the second row in the third column; S4 is connected to D8 through the data selection circuit and transmitted to the subpixel in the second row in the fourth column. Based on the example, those skilled in the art can envisage the working process of an array substrate having m rows and n columns, which would not be repeated here.

Embodiment of the present disclosure provide a method for driving an array substrate. When the ith gate line is scanned, transmitting, by the first data line of the subpixels of each column, the data signal to the subpixels corresponding to the (2i−1)th row through the data selection circuit of the first data selector, and transmitting, by the second data line of the subpixels of each column, the data signal to the subpixels corresponding to the 2ith row through the data selection circuit of the second data selector.

It follows that, before the data signal is transmitted to the light-emission visible region of the electroluminescent diode, a data selector is used to connect a data signal to the two signal data lines, i.e., under a condition that the design of the light-emission visible region of the electroluminescent diode as shown in the example according to FIG. 1 is unchanged, two data signal lines corresponding to each column of subpixels are combined in a non-visible region by the data selector, i.e., the number of data lines is reduced from 2n to n. Such a design could simplify the structure of the array substrate and reduce the manufacturing cost. In a case where the number of the gate signal lines is halved, while the number of the data signal lines is not increased, an effect of increasing time to charge and increasing time for reading the threshold voltage is achieved.

In at least one embodiment of the present disclosure, a pixel compensation circuit is provided, wherein the subpixel comprises a pixel circuit, the pixel circuit comprises an electroluminescent diode, a storage capacitor, a driving sub-circuit and six switching sub-circuits; wherein each switching sub-circuit comprises a control terminal, a first signal terminal and a second signal terminal, wherein a control signal inputted at the control terminal of the switching sub-circuit can turn on or off the first signal terminal and the second signal terminal; the driving sub-circuit comprises a control terminal, a signal input terminal and an output terminal, wherein the control terminal and the signal input terminal of the driving sub-circuit are used to control output of a drive signal at the drive terminal; the storage capacitor comprises a first terminal and a second terminal, wherein a first power source signal is inputted to the first terminal, the second terminal is connected to the control terminal of the driving sub-circuit, and the storage capacitor is used to maintain potential at the control terminal of the driving sub-circuit; the electroluminescent diode comprises a first terminal and a second terminal, wherein the first terminal is connected to the output terminal of the driving sub-circuit, a second power source signal is inputted to the second terminal, and the electroluminescent diode is used for emitting light in response to a light-emission control signal; the control terminal of the driving sub-circuit is connected to the second terminal of the storage capacitor, a first power source signal or the data signal on the data line is inputted to the signal input terminal, the output terminal is connected to the first terminal of the electroluminescent diode, and the driving sub-circuit is used for to drive the electroluminescent diode to emit light;

in the first switching sub-circuit, a reset control signal is inputted to the control terminal, a reset power source signal is inputted to the first signal terminal, the second signal terminal is connected to the control terminal of the driving sub-circuit, and the switching sub-circuit is configured to be turned on in response to the reset control signal in order to transmit the reset power source signal to the control terminal of the driving sub-circuit;

in the second switching sub-circuit, a write control signal is inputted to the control terminal, the first signal terminal is connected to the control terminal of the driving sub-circuit, the second signal terminal is connected to the output terminal of the driving sub-circuit, and the switching sub-circuit is configured to be turned on in response to the write control signal on the gate line in order to connect the control terminal of the driving sub-circuit with the output terminal of the driving sub-circuit;

in the fourth switching sub-circuit, a light-emission control signal is inputted to the control terminal, a first power source signal is inputted to the first signal terminal, the second signal terminal is connected to the signal input terminal of the driving sub-circuit, and the switching sub-circuit is configured to be turned on in response to the light-emission control signal in order to transmit the first power source signal to the signal input terminal of the driving sub-circuit;

in the fifth switching sub-circuit, a light-emission control signal is inputted to the control terminal, the first signal terminal is connected to the output terminal of the driving sub-circuit, the second signal terminal is connected to the first terminal of the electroluminescent diode, and the switching sub-circuit is configured to be turned on in response to the light-emission control signal in order to transmit the signal at the output terminal of the driving sub-circuit to the first terminal of the electroluminescent diode;

in the sixth switching sub-circuit, a write control signal is inputted to the control terminal, the data signal on the data line is inputted to the first signal terminal, the second signal terminal is connected to the signal input terminal of the driving sub-circuit, and the switching sub-circuit is configured to be turned on in response to the write control signal in order to transmit the data signal on the data line to the signal input terminal of the driving sub-circuit;

in the seventh switching sub-circuit, a write control signal is inputted to the control terminal, the reset power source signal is inputted to the first signal terminal, the second signal terminal is connected to the first terminal of the electroluminescent diode, and the switching sub-circuit is configured to be turned on in response to the write control signal on the gate line in order to transmit the reset power source signal to the first terminal of the electroluminescent diode.

In at least one embodiment, the first switching sub-circuit, the second switching sub-circuit, and the fourth to eighth switching sub-circuits are switching transistors, wherein a gate electrode of the switching transistor serves as the control terminal of the switching sub-circuit, a source electrode of the switching transistor serves as the first signal terminal or the second signal terminal of the switching sub-circuit, and a drain electrode of the switching transistor serves as the second signal terminal or the first signal terminal of the switching sub-circuit;

the driving sub-circuit is a driving transistor, wherein a gate electrode of the driving transistor serves as the control terminal of the driving sub-circuit, a source electrode of the driving transistor serves as the signal input terminal of the driving sub-circuit, and a drain electrode of the driving transistor serves as the output terminal of the driving sub-circuit.

Figure 3:
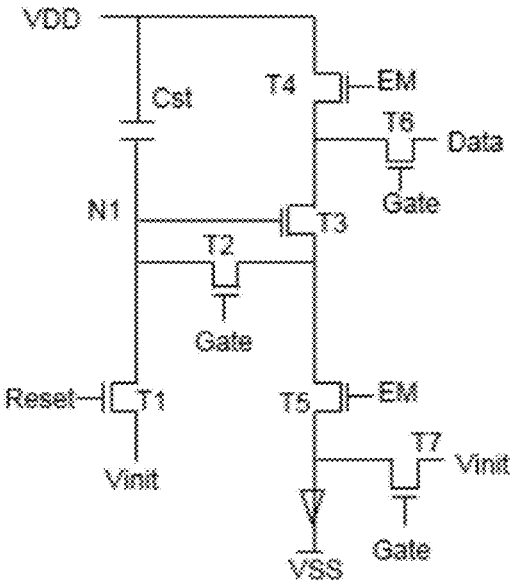
FIG. 3 is a schematic diagram showing the structure of a pixel compensation circuit according to at least one embodiment of the present disclosure.

In an example, as shown in FIG. 3, a data signal Data and a threshold voltage of the driving transistor are written to the second terminal of the storage capacitor, such that the threshold voltage of the driving transistor is prestored in the energy storage element. Thus, when the time to charge is sufficiently long, so that a drive current is generated in the driving transistor to control the electroluminescent diode to emit light, the threshold voltage of the driving transistor would be counteracted, thereby eliminating influence of the threshold voltage offset on the display luminance and compensating for the pixel, and further ensuring uniformity in output current and thus ensuring uniformity in display luminance of the respective pixels.

The electroluminescent diode employed in the example of the present disclosure is not limited to an Organic Light Emitting Diode (OLED), but may include electroluminescent diodes in other forms.

At least one embodiment of the present disclosure provides a method for driving said array substrate, the method comprising: a reset stage, in which the reset control signal is used to turn on the first switching sub-circuit and to turn off the second switching sub-circuit, the fourth switching sub-circuit, the fifth switching sub-circuit, the sixth switching sub-circuit and the seventh switching sub-circuit, such that the reset power source signal is transmitted to the control terminal of the driving sub-circuit, and the first power source and the reset power source are used to charge the storage capacitor;

a write stage, in which the write control signal on the gate line is used to turn on the second switching sub-circuit, the sixth switching sub-circuit and the seventh switching sub-circuit and to turn off the first switching sub-circuit, the fourth switching sub-circuit and the fifth switching sub-circuit, such that the first power source signal is written to the first terminal of the storage capacitor, the data signal and a threshold voltage of the driving sub-circuit are written to the second terminal of the storage capacitor, and the reset power source signal is transmitted to the subpixel; and a light-emission stage, in which the light-emission control signal is used to turn on the fourth switching sub-circuit and the fifth switching sub-circuit and to turn off the first switching sub-circuit, the second switching sub-circuit, the sixth switching sub-circuit and the seventh switching sub-circuit, such that the driving sub-circuit is turned on by the voltage signal in the storage capacitor to cause the first power source signal to drive the subpixel.

Figure 4:
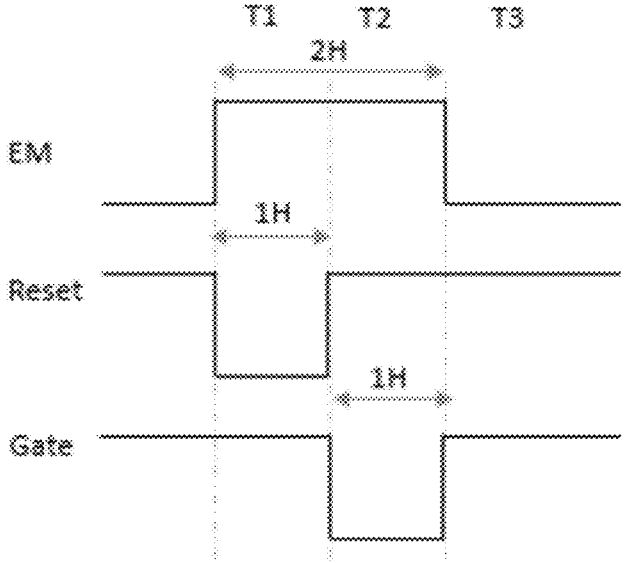
FIG. 4 is a schematic diagram showing the time sequence state of the pixel compensation circuit according to at least one embodiment of the present disclosure.
Figure 5A:
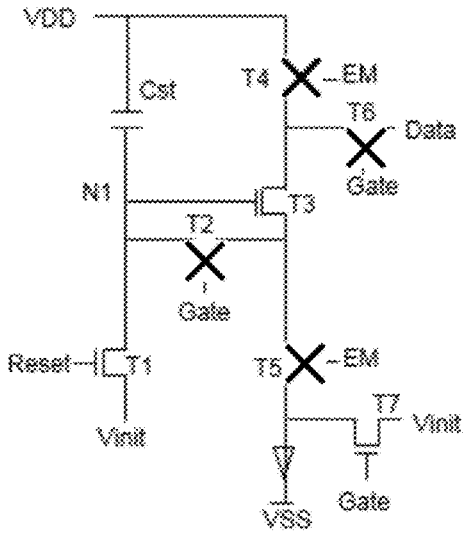
FIGS. 5*a*-5*c* are schematic diagrams showing equivalent circuits of the pixel compensation circuit according to at least one embodiment of the present disclosure at the first to third stages.
Figure 5B:
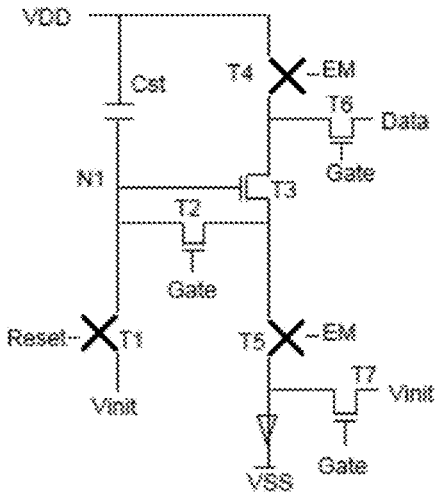
Figure 5C:
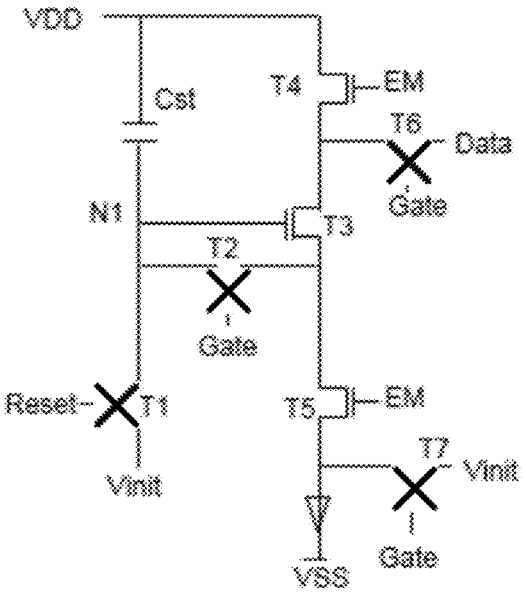

In an example, according to the schematic diagram showing the structure of a pixel compensation circuit according to at least one embodiment of the present disclosure as shown in FIG. 3, in combination with the schematic diagram showing the time sequence state of the pixel compensation circuit according to at least one embodiment of the present disclosure as shown in FIG. 4, and also referring to the schematic diagrams showing wording states of the equivalent circuits of the pixel compensation circuit at the respective stages as shown in FIGS. 5*a*-5*c*, all the transistors are P-type transistors, for example, which are turned on when the driving voltage is at a low level. The working principle of the circuit is described as follows:

A first stage T1 is a reset stage. In this stage, a reset control signal Reset is at a low level, the EM light-emission control signal and Gate write control signal are at a high level, and at this time, the equivalent circuit is as shown in FIG. 5*a*. At this time, a first power source signal is transmitted to the first terminal of the storage capacitor, a reset power source signal Vinit is transmitted, through the first switching sub-circuit, to the control terminal of the driving sub-circuit and the second terminal of the storage capacitor for reset, wherein a potential at the point N1 is VDD−Vinit.

A second stage T2 is a write stage. In this stage, Gate write control signal is at a low level, the EM light-emission control signal and Reset control signal are a high level, and at this time, the equivalent circuit is as shown in FIG. 5*b*. At this time, the data signal is transmitted through the sixth switching sub-circuit to the signal input terminal of the driving sub-circuit. Since the second switching sub-circuit is turned on, the control terminal and the output terminal of the driving sub-circuit are connected and in a diode state, so the potential at the control terminal of the driving transistor is changed to Data+Vth, wherein Vth is a threshold voltage of the driving sub-circuit, and the potentials at the two ends of the storage capacitor are VDD and Data+Vth, respectively; the reset power source signal Vnit is transmitted through the seventh switching sub-circuit to the first terminal of the electroluminescent diode, and at this time, the potentials at the two ends of the electroluminescent diode are Vinit and VSS, respectively. It is set that Vinit is less than or equal to VSS, which may effectively prevent abnormal light-emission from the OLED and improve the display quality.

A third stage T3 is a light-emission stage. In this stage, the EM light-emission control signal is at a low level, the Gate write control signal and the Reset control signal are at a high level, and at this time, the equivalent circuit is as shown in FIG. 5*c*. At this time, the first power source signal VDD is transmitted through the fourth switching sub-circuit to the signal input terminal of the driving sub-circuit. According to the principle of capacitance and charge retaining, the potential at the point N1 is kept to be Data+Vth, and at this time VGS=Data+Vth−VDD. The light-emission current Id flows through the driving sub-circuit and the fifth switching sub-circuit to the OLED electroluminescent diode, such that the OLED electroluminescent diode emits light. According to the current equation under a triode saturation state, Id=K(VGS−Vth)2=K(Data+Vth−VDD−Vth)2=K(Data−VDD)2, wherein K is a constant number, i.e., in a case where the time T2 is sufficient, influence of the threshold voltage Vth on the current may be counteracted by the pixel compensation circuit, and the current is associated with only Data and VDD (a fixed voltage) inputted by the data signal.

Meanwhile, the sixth switching sub-circuit is in a closed state, which can prevent drain current from flowing out from the sixth switching circuit when a black image is displayed, thereby ensuring a low luminance of the black image and improving the display effect.

Hence, the pixel compensation circuit can effectively solve the problem of different threshold voltages at the respective transistors due to the process of the low-temperature polycrystalline silicon itself, increase the time for reading the threshold voltage, accurately control current of each pixel, and improve the image display effect.

In at least one embodiment of the present disclosure, a pixel compensation circuit is provided, wherein the subpixel comprises a pixel circuit, the pixel circuit comprises an electroluminescent diode, a storage capacitor, a driving sub-circuit and six switching sub-circuits; wherein each switching sub-circuit comprises a control terminal, a first signal terminal and a second signal terminal, wherein a control signal inputted at the control terminal of the switching sub-circuit can turn on or off the first signal terminal and the second signal terminal; the driving sub-circuit comprises a control terminal, a signal input terminal and an output terminal, wherein the control terminal and the signal input terminal of the driving sub-circuit are used to control output of a drive signal at the drive terminal; the storage capacitor comprises a first terminal and a second terminal, wherein a first power source signal is inputted to the first terminal, the second terminal is connected to the control terminal of the driving sub-circuit, and the storage capacitor is used to maintain potential at the control terminal of the driving sub-circuit; the electroluminescent diode comprises a first terminal and a second terminal, wherein the first terminal is connected to the output terminal of the driving sub-circuit, a second power source signal is inputted to the second terminal, and the electroluminescent diode is used for emitting light in response to a light-emission control signal; the control terminal of the driving sub-circuit is connected to the second terminal of the storage capacitor, a first power source signal or the data signal on the data line is inputted to the signal input terminal, the output terminal is connected to the first terminal of the electroluminescent diode, and the driving sub-circuit is used for to drive the electroluminescent diode to emit light;

in the first switching sub-circuit, a reset control signal is inputted to the control terminal, a reset power source signal is inputted to the first signal terminal, the second signal terminal is connected to the control terminal of the driving sub-circuit, and the switching sub-circuit is configured to be turned on in response to the reset control signal in order to transmit the reset power source signal to the control terminal of the driving sub-circuit;

in the second switching sub-circuit, a write control signal is inputted to the control terminal, the first signal terminal is connected to the control terminal of the driving sub-circuit, the second signal terminal is connected to the output terminal of the driving sub-circuit, and the switching sub-circuit is configured to be turned on in response to the write control signal on the gate line in order to connect the control terminal of the driving sub-circuit with the output terminal of the driving sub-circuit;

in the fourth switching sub-circuit, a write control signal is inputted to the control terminal, the data signal on the data line is inputted to the first signal terminal, the second signal terminal is connected to the first terminal of the storage capacitor, and the switching sub-circuit is configured to be turned on in response to the write control signal on the gate line in order to transmit the data signal on the data line to the first terminal of the storage capacitor;

in the fifth switching sub-circuit, a reset control signal is inputted to the control terminal, a reference power source signal is inputted to the first signal terminal, the second signal terminal is connected to the first terminal of the storage capacitor, and the switching sub-circuit is configured to be turned on in response to the reset control signal in order to transmit the reference power source signal to the first terminal of the storage capacitor;

in the sixth switching sub-circuit, a light-emission control signal is inputted to the control terminal, a reference power source signal is inputted to the first signal terminal, the second signal terminal is connected to the first terminal of the storage capacitor, and the switching sub-circuit is configured to be turned on in response to the light-emission control signal in order to transmit the reference power source signal to the first terminal of the storage capacitor;

in the seventh switching sub-circuit, a light-emission control signal is inputted to the control terminal, the first signal terminal is connected to the output terminal of the driving sub-circuit, the second signal terminal is connected to the first terminal of the electroluminescent diode, and the switching sub-circuit is configured to be turned on in response to the light-emission control signal in order to transmit the signal at the output terminal of the driving sub-circuit to the first terminal of the electroluminescent diode;

in the eighth switching sub-circuit, a write control signal is inputted to the control terminal, a reset power source signal is inputted to the first signal terminal, the second signal terminal is connected to the first terminal of the electroluminescent diode, and the switching sub-circuit is configured to be turned on in response to the write control signal on the gate line in order to transmit the reset power source signal to the first terminal of the electroluminescent diode;

further, the first switching sub-circuit, the second switching sub-circuit, and the fourth to eighth switching sub-circuits are switching transistors, wherein a gate electrode of the switching transistor serves as the control terminal of the switching sub-circuit, a source electrode of the switching transistor serves as the first signal terminal or the second signal terminal of the switching sub-circuit, and a drain electrode of the switching transistor serves as the second signal terminal or the first signal terminal of the switching sub-circuit;

the driving sub-circuit is a driving transistor, wherein a gate electrode of the driving transistor serves as the control terminal of the driving sub-circuit, a source electrode of the driving transistor serves as the signal input terminal of the driving sub-circuit, and a drain electrode of the driving transistor serves as the output terminal of the driving sub-circuit.

Figure 6:
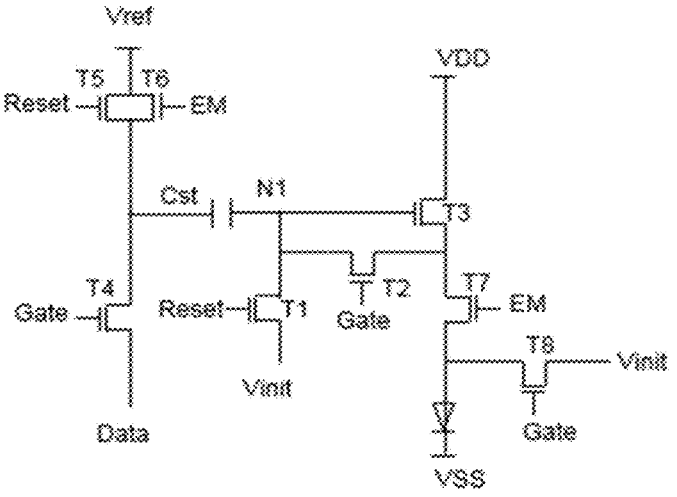
FIG. 6 is a schematic diagram showing the structure of the pixel compensation circuit according to at least one embodiment of the present disclosure.

In an example, as shown in FIG. 6, a first power source signal VDD and a threshold voltage of the driving transistor are written to the second terminal of the storage capacitor, such that the first power source signal and the threshold voltage of the driving transistor are prestored in the energy storage element. Thus, when the time to charge is sufficiently long, so that a drive current is generated in the driving transistor to control the electroluminescent diode to emit light, the threshold voltage of the driving sub-circuit would be counteracted by the resistance drop on the wire of the first power source signal VDD, thereby eliminating influence of the threshold voltage offset and the resistance drop on the wire of the first power source signal VDD on the display luminance and compensating for the pixel, and further ensuring uniformity in output current and thus ensuring uniformity in display luminance of the respective pixels.

At least one embodiment of the present disclosure provides a method for driving said array substrate, the method comprising: a reset stage, in which the reset control signal is used to turn on the first switching sub-circuit and the fifth switching sub-circuit and to turn off the second switching sub-circuit, the fourth switching sub-circuit, the sixth switching sub-circuit, the seventh switching sub-circuit and the seventh switching sub-circuit, such that the reset power source signal is transmitted to the control terminal of the driving sub-circuit, and the reference power source and the reset power source are used to charge the storage capacitor;

a write stage, in which the write control signal is used to turn on the second switching sub-circuit, the fourth switching sub-circuit and the eighth switching sub-circuit and to turn off the first switching sub-circuit, the fifth switching sub-circuit, the sixth switching sub-circuit and the seventh switching sub-circuit, such that the data signal is written to the first terminal of the storage capacitor, the data signal and a threshold voltage of the driving sub-circuit are written to the second terminal of the energy storage element, and the reset power source signal is transmitted to the subpixel; and a light-emission stage, in which the light-emission control signal is used to turn on the sixth switching sub-circuit and the seventh switching sub-circuit and to turn off the first switching sub-circuit, the second switching sub-circuit, the fourth switching sub-circuit, the fifth switching sub-circuit and the eighth switching sub-circuit, such that the reference power source signal is transmitted to the first terminal of the energy storage element, and the driving sub-circuit is turned on by the voltage signal in the storage capacitor to cause the first power source signal to drive the subpixel.

Figure 7A:
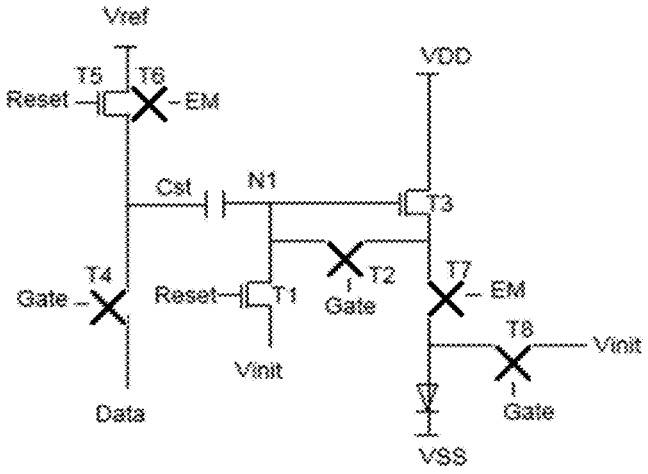
FIGS. 7*a*-7*c* are schematic diagrams showing equivalent circuits of the pixel compensation circuit according to at least one embodiment of the present disclosure at the first to third stages.
Figure 7B:
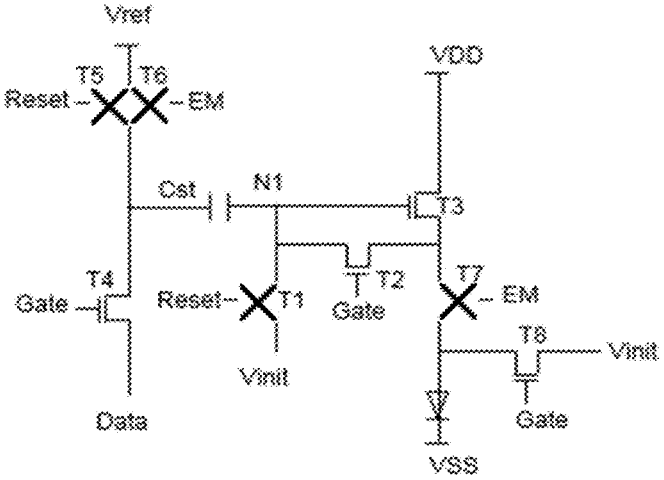
Figure 7C:
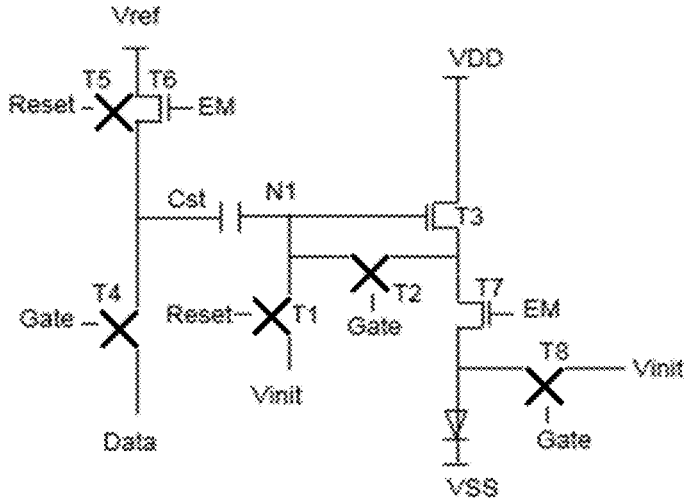

In an example, according to the schematic diagram showing the structure of a pixel compensation circuit according to at least one embodiment of the present disclosure as shown in FIG. 6, in combination with the schematic diagram showing the time sequence state of the pixel compensation circuit according to at least one embodiment of the present disclosure as shown in FIG. 4, and also referring to the schematic diagrams showing wording states of the equivalent circuits of the pixel compensation circuit at the respective stages as shown in FIGS. 57*a*-7*c*, all the transistors are P-type transistors, for example, which are turned on when the driving voltage is at a low level. The working principle of the circuit is described as follows:

A first stage T1 is a reset stage. In this stage, a reset control signal Reset is at a low level, the EM light-emission control signal and Gate write control signal are at a high level, and at this time, the equivalent circuit is as shown in FIG. 7*a*. At this time, a reference power source signal is transmitted to the first terminal of the storage capacitor, a reset power source signal Vinit is transmitted, through the first switching sub-circuit, to the control terminal of the driving sub-circuit and the second terminal of the storage capacitor for reset, wherein a potential at the point N1 is Vref−Vinit.

A second stage T2 which is a write stage: in this stage, Gate writes a control signal is at a low level, the EM light-emission control signal and Reset control signal are at a high level, and at this time, the equivalent circuit is as shown in FIG. 7*b*. At this time, the data signal is transmitted through the fourth switching sub-circuit to the second terminal of the storage capacitor; the first power source signal is transmitted to the signal input terminal of the driving sub-circuit. Since the second switching sub-circuit is turned on, the control terminal and the second terminal of the driving sub-circuit are connected and in a diode state, so the potential at the control terminal of the driving transistor is changed to VDD+Vth, wherein Vth is a threshold voltage of the driving sub-circuit, and the potentials at the two ends of the storage capacitor are Data and VDD+Vth, respectively, and the potential at the point N1 is VDD+Vth−Data; the reset power source signal Vnit is transmitted through the eighth switching sub-circuit to the first terminal of the electroluminescent diode, and at this time, the potentials at the two ends of the electroluminescent diode are Vinit and VSS, respectively. It is set that Vinit is less than or equal to VSS, which may effectively prevent abnormal light-emission from the OLED and improve the display quality.

A third stage T3 is a light-emission stage. In this stage, the EM light-emission control signal is at a low level, the Gate write control signal and the Reset control signal are at a high level, and at this time, the equivalent circuit is as shown in FIG. 7*c*. At this time, the reference power source signal Vref is transmitted through the sixth switching sub-circuit to the first terminal of the storage capacitor. According to the principle of capacitance and charge retaining, the potential at the point N1 is VDD+Vth−Data+Vref, and at this time VGS=VDD+Vth−Data+Vref−VDD=Vth−Data+Vref. The light-emission current Id flows through the driving sub-circuit and the seventh switching sub-circuit to the OLED electroluminescent diode, such that the OLED electroluminescent diode emits light. According to the current formula under a triode saturation state, Id=K(VGS−Vth)2=K(Data+Vth−VDD−Vth)2=K(Data−VDD)2, wherein K is a constant number, i.e., in a case where the time T2 is sufficient, according to said equation, the current flowing through the electroluminescent diode is not associated with the threshold voltage Vth of the driving sub-circuit or with the first power source VDD, but is associated with only Data inputted through the data signal and the reference voltage Vref. The sixth switching sub-circuit is in a closed state, which can prevent drain current from flowing out from the sixth switching circuit when a black image is displayed, thereby ensuring a low luminance of the black image.

Hence, this method can effectively compensate for the threshold voltage Vth of the driving sub-circuit and the resistance drop on the wire of the first power source VDD, solve the problem of different threshold voltages at the respective transistors due to the process of the low-temperature polycrystalline silicon itself, increase the time for reading the threshold voltage, accurately control current of each pixel, and improve the image display effect.

At least one embodiment of the present disclosure provides a display panel, comprising an array substrate provided by any of the above examples.

At least one example of the present disclosure provides a display device, comprising the above-mentioned display panel. The display device may be: any product or component having a display function, such as a mobile phone, a tablet computer, a television, a display, a notebook computer, a digital photo frame, and a navigator.

The above examples of the present disclosure are provided only to clearly illustrate the present disclosure, but shall by no means limit the embodiment of the present disclosure. Those skilled in the art may make modifications or changes in any different form on the basis of the above illustration. Not all embodiments can be exemplified here, and any obvious change or modification based on the technical solution of the present disclosure still falls into the scope of protection sought for in the present disclosure.

What is claimed is:

1. An array substrate, comprising:

m rows and n columns of subpixels, wherein m and n are positive integers;

a plurality of gate lines, wherein for all m rows of subpixels, where m is an even number and i<(m+1)/2, an ith gate line of the plurality of gate lines is connected to the subpixels in the (2i−1)th row and the 2ith row, and wherein for all m rows of subpixels where m is an odd number and where i<(m+1)/2, the ith gate line of the plurality of gate lines is connected to the subpixels in the (2i−1)th row and the 2ith row and where i=(m+1)/2, the ith gate line of the plurality of gate lines is connected to the subpixels in the mth row, wherein i is a positive integer less than or equal to (m+1)/2; and a plurality of data lines, wherein each column of subpixels corresponds to two data lines that include a first data line and a second data line, wherein the first data line is connected to the subpixels in the column which are in odd rows, and the second data line is connected to the subpixels in the column which are in even rows, wherein each subpixel of the m rows and the n columns of subpixels comprises a pixel circuit, the pixel circuit comprising an electroluminescent diode, a storage capacitor, a driving sub-circuit and six switching sub-circuits, and wherein each switching sub-circuit comprises a control terminal, a first signal terminal and a second signal terminal, wherein a control signal inputted at the control terminal of the switching sub-circuit turns on or turns off the first signal terminal and the second signal terminal;

the driving sub-circuit comprises a control terminal, a signal input terminal and an output terminal, wherein the control terminal and the signal input terminal of the driving sub-circuit are configured to control output of a drive signal at a drive terminal;

the storage capacitor comprises a first terminal and a second terminal, wherein a first power source signal is inputted to the first terminal, the second terminal is connected to the control terminal of the driving sub-circuit, and the storage capacitor is configured to maintain potential at the control terminal of the driving sub-circuit;

the electroluminescent diode comprises a first terminal and a second terminal, wherein the first terminal is connected to the output terminal of the driving sub-circuit, a second power source signal is inputted to the second terminal, and the electroluminescent diode is configured to emit light in response to a light-emission control signal;

the control terminal of the driving sub-circuit is connected to the second terminal of the storage capacitor, a first power source signal or a data signal on the first data line is inputted to the signal input terminal of the driving sub-circuit, the output terminal of the driving sub-circuit is connected to the first terminal of the electroluminescent diode, and the driving sub-circuit is configured to drive the electroluminescent diode to emit light;

in a first switching sub-circuit, a reset control signal is inputted to the control terminal, a reset power source signal is inputted to the first signal terminal, the second signal terminal is connected to the control terminal of the driving sub-circuit, and the first switching sub-circuit is configured to be turned on in response to the reset control signal in order to transmit the reset power source signal to the control terminal of the driving sub-circuit;

in a second switching sub-circuit, a write control signal is inputted to the control terminal, the first signal terminal is connected to the control terminal of the driving sub-circuit, the second signal terminal is connected to the output terminal of the driving sub-circuit, and the second switching sub-circuit is configured to be turned on in response to the write control signal on a respective gate line of the plurality of gate lines in order to connect the control terminal of the driving sub-circuit with the output terminal of the driving sub-circuit;

in a fourth switching sub-circuit, a light-emission control signal is inputted to the control terminal, a first power source signal is inputted to the first signal terminal, the second signal terminal is connected to the signal input terminal of the driving sub-circuit, and the fourth switching sub-circuit is configured to be turned on in response to the light-emission control signal in order to transmit the first power source signal to the signal input terminal of the driving sub-circuit;

in a fifth switching sub-circuit, a light-emission control signal is inputted to the control terminal, the first signal terminal is connected to the output terminal of the driving sub-circuit, the second signal terminal is connected to the first terminal of the electroluminescent diode, and the fifth switching sub-circuit is configured to be turned on in response to the light-emission control signal in order to transmit the signal at the output terminal of the driving sub-circuit to the first terminal of the electroluminescent diode;

in a sixth switching sub-circuit, a write control signal is inputted to the control terminal, the data signal on the first data line is inputted to the first signal terminal, the second signal terminal is connected to the signal input terminal of the driving sub-circuit, and the sixth switching sub-circuit is configured to be turned on in response to the write control signal in order to transmit the data signal on the first data line to the signal input terminal of the driving sub-circuit; and in a seventh switching sub-circuit, a write control signal is inputted to the control terminal, the reset power source signal is inputted to the first signal terminal, the second signal terminal is connected to the first terminal of the electroluminescent diode, and the seventh switching sub-circuit is configured to be turned on in response to the write control signal on the gate line in order to transmit the reset power source signal to the first terminal of the electroluminescent diode.

2. The array substrate according to claim 1, further comprising a first data selector and a second data selector, the first data selector and the second data selector including n data selection circuits, wherein:

data selection circuits of the first data selector, responsive to a first data selection signal, provide to the first data line of each column of subpixels data signals of the subpixels in the column;

data selection circuits of the second data selector, responsive to a second data selection signal, provide to the second data line of the column of subpixels data signals of the subpixels in the column, wherein the first data selection signal and the second data selection signal have opposite phases.

3. The array substrate according to claim 2, wherein each data selection circuit comprises a control terminal, a first terminal and a second terminal, wherein:

in each data selection circuit of the first data selector, the control terminal receives a selection signal of the first data selector, the first terminal is connected to the first data line of each column of subpixels, and the second terminal receives a respective data signal of the data signals of the subpixels in the column; and in each data selection circuit of the second data selector, the control terminal receives a selection signal of the second data selector, the first terminal is connected to the second data line of each column of subpixels, and the second terminal receives a respective data signal of the data signals of the subpixels in the column.

4. The array substrate according to claim 1, wherein:

the first switching sub-circuit, the second switching sub-circuit, and the fourth to seventh switching sub-circuits are switching transistors, wherein a respective gate electrode of a respective switching transistor serves as the control terminal of a respective switching sub-circuit, a respective source electrode of a respective switching transistor serves as the first signal terminal or the second signal terminal of a respective switching sub-circuit, and a respective drain electrode of a respective switching transistor serves as the second signal terminal or the first signal terminal of a respective switching sub-circuit; and the driving sub-circuit is a driving transistor, wherein a gate electrode of the driving transistor serves as the control terminal of the driving sub-circuit, a source electrode of the driving transistor serves as the signal input terminal of the driving sub-circuit, and a drain electrode of the driving transistor serves as the output terminal of the driving sub-circuit.

5. A display panel, comprising the array substrate according to claim 1.

6. A display device, comprising the display panel according to claim 5.

7. The display panel according to claim 5, the array substrate further comprises a first data selector and a second data selector, each of the first data selector and second data selector including n data selection circuits, wherein:

data selection circuits of the first data selector, responsive to a first data selection signal, provide to the first data line of each column of subpixels data signals of the subpixels in the column; and data selection circuits of the second data selector, responsive to a second data selection signal, provide to the second data line of the column of subpixels data signals of the subpixels in the column, wherein the first data selection signal and the second data selection signal have opposite phases.

8. The display panel according to claim 7, wherein each data selection circuit comprises a control terminal, a first terminal and a second terminal, and wherein:

in the data selection circuit of the first data selector, the control terminal receives a selection signal of the first data selector, the first terminal is connected to the first data line of each column of subpixels, and the second terminal receives the data signal; and in the data selection circuit of the second data selector, the control terminal receives a selection signal of the second data selector, the first terminal is connected to the second data line of each column of subpixels, and the second terminal receives the data signal.

9. The display panel according to claim 5, wherein:

the first switching sub-circuit, the second switching sub-circuit, and the fourth to seventh switching sub-circuits are switching transistors, wherein a respective gate electrode of a respective switching transistor serves as the control terminal of a respective switching sub-circuit, a respective source electrode of a respective switching transistor serves as the first signal terminal or the second signal terminal of a respective switching sub-circuit, and a respective drain electrode of a respective switching transistor serves as the second signal terminal or the first signal terminal of a respective switching sub-circuit; and the driving sub-circuit is a driving transistor, wherein a gate electrode of the driving transistor serves as the control terminal of the driving sub-circuit, a source electrode of the driving transistor serves as the signal input terminal of the driving sub-circuit, and a drain electrode of the driving transistor serves as the output terminal of the driving sub-circuit.

10. An array substrate, comprising:

m rows and n columns of subpixels, wherein m and n are positive integers;

a plurality of gate lines, wherein for all m rows of subpixels, where m is an even number and $i<(m+1)/2$, an ith gate line of the plurality of gate lines is connected to the subpixels in the $(2i-1)$th row and the 2ith row, and wherein for all m rows of subpixels where m is an odd number and where $i<(m+1)/2$, the ith gate line of the plurality of gate lines is connected to the subpixels in the $(2i-1)$th row and the 2ith row and where $i=(m+1)/2$, the ith gate line of the plurality of gate lines is connected to the subpixels in the mth row, wherein i is a positive integer less than or equal to $(m+1)/2$; and a plurality of data lines, wherein each column of subpixels corresponds to two data lines that include a first data line and a second data line, wherein the first data line is connected to the subpixels in the column which are in odd rows, and the second data line is connected to the subpixels in the column which are in even rows, wherein:

each subpixel of the m rows and then columns of subpixels comprises a pixel circuit, the pixel circuit comprising an electroluminescent diode, a storage capacitor, a driving sub-circuit and seven switching sub-circuits, and each switching sub-circuit comprises a control terminal, a first signal terminal and a second signal terminal, wherein a control signal inputted at the control terminal of the switching sub-circuit turns on or turns off the first signal terminal and the second signal terminal;

the driving sub-circuit comprises a control terminal, a signal input terminal and an output terminal, wherein the control terminal and the signal input terminal of the driving sub-circuit are configured to control output of a drive signal at a drive terminal;

the storage capacitor comprises a first terminal and a second terminal, wherein a reference power source signal or a data signal on a respective data line of the plurality of data lines is inputted to the first terminal, the second terminal is connected to the control terminal of the driving sub-circuit, and the storage capacitor is configured to maintain potential at the control terminal of the driving sub-circuit;

the electroluminescent diode comprises a first terminal and a second terminal, wherein the first terminal is connected to the output terminal of the driving sub-circuit, a second power source signal is inputted to the second terminal, and the electroluminescent diode is configured to emit light in response to a light-emission control signal;

the control terminal of the driving sub-circuit is connected to the second terminal of the storage capacitor, a first power source signal is inputted to the signal input terminal of the driving sub-circuit, the output terminal of the driving sub-circuit is connected to the first terminal of the electroluminescent diode, and the driving sub-circuit is configured to drive the electroluminescent diode to emit light;

in a first switching sub-circuit, a reset control signal is inputted to the control terminal, a reset power source signal is inputted to the first signal terminal, the second signal terminal is connected to the control terminal of the driving sub-circuit, and the first switching sub-circuit is configured to be turned on in response to the reset control signal in order to transmit the reset power source signal to the control terminal of the driving sub-circuit;

in a second switching sub-circuit, a write control signal is inputted to the control terminal, the first signal terminal is connected to the control terminal of the driving sub-circuit, the second signal terminal is connected to the output terminal of the driving sub-circuit, and the second switching sub-circuit is configured to be turned on in response to the write control signal on a respective gate line in order to connect the control terminal of the driving sub-circuit with the output terminal of the driving sub-circuit;

in a fourth switching sub-circuit, a write control signal is inputted to the control terminal, the data signal on the data line is inputted to the first signal terminal, the second signal terminal is connected to the first terminal of the storage capacitor, and the fourth switching sub-circuit is configured to be turned on in response to the write control signal on the gate line in order to transmit the data signal on the data line to the first terminal of the storage capacitor;

in a fifth switching sub-circuit, a reset control signal is inputted to the control terminal, a reference power source signal is inputted to the first signal terminal, the second signal terminal is connected to the first terminal of the storage capacitor, and the fifth switching sub-circuit is configured to be turned on in response to the reset control signal in order to transmit the reference power source signal to the first terminal of the storage capacitor;

in a sixth switching sub-circuit, a light-emission control signal is inputted to the control terminal, a reference power source signal is inputted to the first signal terminal, the second signal terminal is connected to the first terminal of the storage capacitor, and the sixth switching sub-circuit is configured to be turned on in response to the light-emission control signal in order to transmit the reference power source signal to the first terminal of the storage capacitor;

in a seventh switching sub-circuit, a light-emission control signal is inputted to the control terminal, the first signal terminal is connected to the output terminal of the driving sub-circuit, the second signal terminal is connected to the first terminal of the electroluminescent diode, and the seventh switching sub-circuit is configured to be turned on in response to the light-emission control signal in order to transmit a signal at the output terminal of the driving sub-circuit to the first terminal of the electroluminescent diode; and in an eighth switching sub-circuit, a write control signal is inputted to the control terminal, a reset power source signal is inputted to the first signal terminal, the second signal terminal is connected to the first terminal of the electroluminescent diode, and the eighth switching sub-circuit is configured to be turned on in response to the write control signal on the gate line in order to transmit the reset power source signal to the first terminal of the electroluminescent diode.

11. The array substrate according to claim 10, wherein:

the first switching sub-circuit, the second switching sub-circuit, and the fourth to eighth switching sub-circuits are switching transistors, wherein a respective gate electrode of a respective switching transistor serves as the control terminal of a respective switching sub-circuit, a respective source electrode of a respective switching transistor serves as the first signal terminal or the second signal terminal of a respective switching sub-circuit, and a respective drain electrode of a respective switching transistor serves as the second signal terminal or the first signal terminal of a respective switching sub-circuit; and the driving sub-circuit is a driving transistor, wherein a gate electrode of the driving transistor serves as the control terminal of the driving sub-circuit, a source electrode of the driving transistor serves as the signal input terminal of the driving sub-circuit, and a drain electrode of the driving transistor serves as the output terminal of the driving sub-circuit.

12. A method for driving an array substrate according to claim 10, the method comprising:

when the ith gate line is scanned, transmitting, by the first data line of the subpixels of each column, a data signal to the subpixels corresponding to the (2i−1)th row, and transmitting, by the second data line of the subpixels of each column, the data signal to the subpixels corresponding to the 2ith row;

a reset stage, in which the reset control signal is used to turn on the first switching sub-circuit and the fifth switching sub-circuit and to turn off the second switching sub-circuit, the fourth switching sub-circuit, the sixth switching sub-circuit, the seventh switching sub-circuit and the eighth switching sub-circuit, such that the reset power source signal is transmitted to the control terminal of the driving sub-circuit, and the first power source signal and the reset power source signal are used to charge the storage capacitor;

a write stage, in which the write control signal is used to turn on the second switching sub-circuit, the fourth switching sub-circuit and the eighth switching sub-circuit and to turn off the first switching sub-circuit, the fifth switching sub-circuit, the sixth switching sub-circuit and the seventh switching sub-circuit, such that the data signal is written to the first terminal of the storage capacitor, the data signal and a threshold voltage of the driving sub-circuit are written to the second terminal of an energy storage element, and the reset power source signal is transmitted to the subpixel; and a light-emission stage, in which the light-emission control signal is used to turn on the sixth switching sub-circuit and the seventh switching sub-circuit and to turn off the first switching sub-circuit, the second switching sub-circuit, the fourth switching sub-circuit, the fifth switching sub-circuit and the eighth switching sub-circuit, such that the reference power source signal is transmitted to the first terminal of the energy storage element, and the driving sub-circuit is turned on by a voltage signal in the storage capacitor to cause the first power source signal to drive the subpixel.

13. The method according to claim 12, wherein the array substrate further comprises a first data selector and a second data selector, the first data selector and the second data selector including n data selection circuits, and wherein the method further comprises:

when the ith gate line is scanned, transmitting, by the first data line of the subpixels of each column, the data signal to the subpixels corresponding to the (2i−1)th row through a data selection circuit of the first data selector, and transmitting, by the second data line of the subpixels of each column, the data signal to the subpixels corresponding to the 2ith row through the data selection circuit of the second data selector.

14. The array substrate according to claim 10, further comprising a first data selector and a second data selector, the first data selector and the second data selector including n data selection circuits, wherein:

data selection circuits of the first data selector, responsive to a first data selection signal, provide to the first data line of each column of subpixels data signals of the subpixels in the column; and data selection circuits of the second data selector, responsive to a second data selection signal, provide to the second data line of the column of subpixels data signals of the subpixels in the column, wherein the first data selection signal and the second data selection signal have opposite phases.

15. The array substrate according to claim 14, wherein each data selection circuit comprises a control terminal, a first terminal, and a second terminal, wherein:

in each data selection circuit of the first data selector, the control terminal receives a selection signal of the first data selector, the first terminal is connected to the first data line of each column of subpixels, and the second terminal receives a respective data signal of the data signals of the subpixels in the column; and in each data selection circuit of the second data selector, the control terminal receives a selection signal of the second data selector, the first terminal is connected to the second data line of each column of subpixels, and the second terminal receives a respective data signal of the data signals of the subpixels in the column.

16. A display panel, comprising the array substrate according to claim 10.

17. A display device, comprising the display panel according to claim 16.

18. A method for driving an array substrate, the array substrate comprising m rows and n columns of subpixels, a plurality of gate lines and a plurality of data lines, wherein m and n are positive integers; wherein if m is an even number, when $i<(m+1)/2$, the ith gate line is connected to the subpixels in the (2i−1)th row and the 2ith row, and wherein if m is an odd number, when $i<(m+1)/2$, the ith gate line is connected to the subpixels in the (2i−1)th row and the 2ith row and when $i=(m+1)/2$, the ith gate line is connected to the subpixels in the mth row, wherein i is a positive integer less than or equal to $(m+1)/2$; wherein each column of subpixels corresponds to two data lines that include a first data line and a second data line, wherein the first data line is connected to the subpixels in the column which are in odd rows, and the second data line is connected to the subpixels in the column which are in even rows, the method comprising:

when the ith gate line is scanned, transmitting, by the first data line of the subpixels of each column, a data signal to the subpixels corresponding to the (2i−1)th row, and transmitting, by the second data line of the subpixels of each column, the data signal to the subpixels corresponding to the 2ith row, wherein:

each subpixel of the m rows and the n columns of subpixels comprises a pixel circuit, the pixel circuit comprises an electroluminescent diode, a storage capacitor, a driving sub-circuit and six switching sub-circuits; and each switching sub-circuit comprises a control terminal, a first signal terminal and a second signal terminal, wherein a control signal inputted at the control terminal of the switching sub-circuit turns on or turns off the first signal terminal and the second signal terminal; the driving sub-circuit comprises a control terminal, a signal input terminal and an output terminal, wherein the control terminal and the signal input terminal of the driving sub-circuit are configured to control output of a drive signal at a driving terminal;

the storage capacitor comprises a first terminal and a second terminal, wherein a first power source signal is inputted to the first terminal, the second terminal is connected to the control terminal of the driving sub-circuit, and the storage capacitor is configured to maintain potential at the control terminal of the driving sub-circuit;

the electroluminescent diode comprises a first terminal and a second terminal, wherein the first terminal is connected to the output terminal of the driving sub-circuit, a second power source signal is inputted to the second terminal, and the electroluminescent diode is configured to emit light in response to a light-emission control signal;

the control terminal of the driving sub-circuit is connected to the second terminal of the storage capacitor, a first power source signal or the data signal on the respective data line of the plurality of data lines is inputted to the signal input terminal of the driving sub-circuit, the output terminal of the driving sub-circuit is connected to the first terminal of the electroluminescent diode, and the driving sub-circuit is configured to drive the electroluminescent diode to emit light;

in a first switching sub-circuit, a reset control signal is inputted to the control terminal, a reset power source signal is inputted to the first signal terminal, the second signal terminal is connected to the control terminal of the driving sub-circuit, and the first switching sub-circuit is configured to be turned on in response to the reset control signal in order to transmit the reset power source signal to the control terminal of the driving sub-circuit;

in a second switching sub-circuit, a write control signal is inputted to the control terminal, the first signal terminal is connected to the control terminal of the driving sub-circuit, the second signal terminal is connected to the output terminal of the driving sub-circuit, and the second switching sub-circuit is configured to be turned on in response to the write control signal on a respective gate line of the plurality of gate lines in order to connect the control terminal of the driving sub-circuit with the output terminal of the driving sub-circuit;

in a fourth switching sub-circuit, a light-emission control signal is inputted to the control terminal, a first power source signal is inputted to the first signal terminal, the second signal terminal is connected to the signal input terminal of the driving sub-circuit, and the fourth switching sub-circuit is configured to be turned on in response to the light-emission control signal in order to transmit the first power source signal to the signal input terminal of the driving sub-circuit;

in a fifth switching sub-circuit, a light-emission control signal is inputted to the control terminal, the first signal terminal is connected to the output terminal of the driving sub-circuit, the second signal terminal is connected to the first terminal of the electroluminescent diode, and the fifth switching sub-circuit is configured to be turned on in response to the light-emission control signal in order to transmit a signal at the output terminal of the driving sub-circuit to the first terminal of the electroluminescent diode;

in a sixth switching sub-circuit, a write control signal is inputted to the control terminal, the data signal on the respective data line of the plurality of data lines is inputted to the first signal terminal, the second signal terminal is connected to the signal input terminal of the driving sub-circuit, and the sixth switching sub-circuit is configured to be turned on in response to the write control signal in order to transmit the data signal on the respective data line to the signal input terminal of the driving sub-circuit; and in a seventh switching sub-circuit, a write control signal is inputted to the control terminal, the reset power source signal is inputted to the first signal terminal, the second signal terminal is connected to the first terminal of the electroluminescent diode, and the seventh switching sub-circuit is configured to be turned on in response to the write control signal on the gate line in order to transmit the reset power source signal to the first terminal of the electroluminescent diode;

the method further comprising:

a reset stage, in which the reset control signal is used to turn on the first switching sub-circuit and to turn off the second switching sub-circuit, the fourth switching sub-circuit, the fifth switching sub-circuit, the sixth switching sub-circuit, and the seventh switching sub-circuit, such that the reset power source signal is transmitted to the control terminal of the driving sub-circuit, and the first power source signal and the reset power source signal are used to charge the storage capacitor;

a write stage, in which the write control signal on the gate line is used to turn on the second switching sub-circuit, the sixth switching sub-circuit, and the seventh switching sub-circuit and to turn off the first switching sub-circuit, the fourth switching sub-circuit, and the fifth switching sub-circuit, such that the first power source signal is written to the first terminal of the storage capacitor, the data signal, and a threshold voltage of the driving sub-circuit are written to the second terminal of the storage capacitor, and the reset power source signal is transmitted to the subpixel; and a light-emission stage, in which the light-emission control signal is used to turn on the fourth switching sub-circuit and the fifth switching sub-circuit and to turn off the first switching sub-circuit, the second switching sub-circuit, the sixth switching sub-circuit, and the seventh switching sub-circuit, such that the driving sub-circuit is turned on by a voltage signal in the storage capacitor to cause the first power source signal to drive the subpixel.

19. The method according to claim 18, wherein the array substrate further comprises a first data selector and a second data selector, the first data selector and the second data selector including n data selection circuits, and wherein the method further comprises:

when the ith gate line is scanned, transmitting, by the first data line of the subpixels of each column, the data signal to the subpixels corresponding to the (2i−1)th row through a data selection circuit of the first data selector, and transmitting, by the second data line of the subpixels of each column, the data signal to the subpixels corresponding to the 2ith row through the data selection circuit of the second data selector.

* * * * *